US009437979B2

(12) United States Patent
Fischer

(10) Patent No.: US 9,437,979 B2
(45) Date of Patent: Sep. 6, 2016

(54) GROUNDING FOR ELECTRICAL CONNECTORS

(71) Applicant: Charles Pitman Fischer, Marlton, NJ (US)

(72) Inventor: Charles Pitman Fischer, Marlton, NJ (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 14/244,638

(22) Filed: Apr. 3, 2014

(65) Prior Publication Data

US 2015/0288108 A1 Oct. 8, 2015

(51) Int. Cl.

| | |
|---|---|
| ***H01R 13/40*** | (2006.01) |
| ***H01R 13/6588*** | (2011.01) |
| ***H01R 13/52*** | (2006.01) |
| ***H01R 13/652*** | (2006.01) |
| ***H01R 13/6598*** | (2011.01) |
| ***H01R 13/6584*** | (2011.01) |
| ***H01R 13/6599*** | (2011.01) |
| *H01R 13/6592* | (2011.01) |

(52) U.S. Cl.

CPC ..... *H01R 13/6588* (2013.01); *H01R 13/5202* (2013.01); *H01R 13/5219* (2013.01); *H01R 13/652* (2013.01); *H01R 13/6584* (2013.01); *H01R 13/6598* (2013.01); *H01R 13/6599* (2013.01); *H01R 13/6592* (2013.01)

(58) Field of Classification Search

CPC .. H01R 43/24; H01R 13/405; H01R 13/521; H01R 13/5202; H01R 13/5205; H01R 13/5208; H01R 13/5219; H01R 13/5221

USPC ..... 439/589, 272–275, 736

See application file for complete search history.

(56) References Cited

U.S. PATENT DOCUMENTS

| | | | | |
|---|---|---|---|---|
| 3,721,943 | A * | 3/1973 | Curr | 439/273 |
| 3,850,495 | A * | 11/1974 | Glover | 439/273 |
| 3,952,218 | A | 4/1976 | Deters | |
| 3,963,297 | A * | 6/1976 | Panek et al. | 439/204 |
| 5,567,170 | A * | 10/1996 | Kroeber | 439/186 |
| 8,267,720 | B2 * | 9/2012 | Ishida | 439/587 |
| 9,035,200 | B2 * | 5/2015 | Kato et al. | 174/359 |

FOREIGN PATENT DOCUMENTS

| | | |
|---|---|---|
| RU | 2364013 C2 | 8/2009 |
| WO | 2013091838 A2 | 6/2013 |

OTHER PUBLICATIONS

The PCT International Search Report and Written Opinion for Corresponding Application No. PCT/US2015/023972. Mailed Aug. 27, 2015 (6 Sheets).

* cited by examiner

*Primary Examiner* — Hien Vu

(74) *Attorney, Agent, or Firm* — King & Spalding LLP

(57) ABSTRACT

A connector can include a first shell having at least one first wall made of an electrically conductive material, where the at least one first wall forms a first cavity. The connector can also include an insert disposed within the first cavity. The connector can further include at least one connector pin disposed in and traversing the first shell. The connector can also include an electrically conductive face seal that abuts against a distal end of the insert within the first cavity, where the at least one connector pin traverses at least one first aperture in the electrically conductive face seal. The connector can further include at least one electrically insulating bushing disposed within the at least one first aperture in the electrically conductive face seal, where the at least one electrically insulating bushing is further disposed between the face seal and the at least one connector pin.

10 Claims, 14 Drawing Sheets

GROUNDING FOR ELECTRICAL CONNECTORS

TECHNICAL FIELD

Embodiments described herein relate generally to electrical connectors, and more particularly to systems, methods, and devices for grounding of electrical connectors using shielded cables.

BACKGROUND

A number of electrical connectors, including standards governing such electrical connectors, were designed decades ago prior to the use of shielded cables. With the use of shielded cables, electromagnetic interference can result when an electrical connector is not properly grounded. Such electromagnetic interference can result in unreliable electrical service to connected equipment and/or in safety concerns.

SUMMARY

In general, in one aspect, the disclosure relates to a connector. The connector can include a first shell having at least one first wall made of an electrically conductive material, where the at least one first wall forms a first cavity. The connector can also include an insert disposed within the first cavity. The connector can further include at least one connector pin disposed within and traversing the insert. The connector can also include an electrically conductive face seal that abuts against a distal end of the insert within the first cavity, where the at least one connector pin traverses at least one first aperture in the electrically conductive face seal. The connector can further include at least one electrically insulating bushing disposed within the at least one first aperture in the electrically conductive face seal, where the at least one electrically insulating bushing is further disposed between the face seal and the at least one connector pin.

In another aspect, the disclosure can generally relate to a face seal. The face seal can include a body having an elastomeric material and an electrically conductive material, wherein the body has a height and an outer perimeter. The face seal can also include at least one first aperture that traverses the height of the body, where the at least one first aperture has a first diameter, where the at least one first aperture is configured to receive at least one bushing. The face seal can further include a second aperture that traverses the height of the body, where the second aperture has a second diameter, where the second aperture is configured to receive a jack screw. The body is configured to be positioned at a proximal end of an insert of an electrical connector.

In yet another aspect, the disclosure can generally relate to a bushing. The bushing can include a first portion having a first height and a first inner portion, where the first inner portion has a first inner diameter and a first outer portion having a first outer diameter, where the first portion is made of an electrically non-conductive material. The bushing can also include a second portion positioned adjacent to the first portion and having a second height, where the second portion has a second inner portion having the first inner diameter and a second outer portion having a second outer diameter, where the second portion is made of the electrically non-conductive material. The first inner portion and the second inner portion can be configured to receive a connector pin of an electrical connector. The first portion can be configured to be positioned inside a third portion of an aperture that traverses a face seal. The second portion can be configured to be positioned inside a fourth portion of the aperture that traverses the face seal. The face seal can include an elastomeric material and an electrically conductive material. The face seal and the second portion can be configured to be positioned proximate to an insert of the electrical connector.

In still another aspect, the disclosure can generally relate to a connector. The connector can include a shell having at least one wall made of an electrically conductive material, where the at least one wall forms a cavity. The connector can also include an insert disposed within the cavity. The connector can further include at least one contact receptacle disposed within and traversing the insert, where the at least one contact receptacle is configured to receive at least one connector pin. The connector can also include an electrically conductive sealing member that is positioned between and abuts against an outer portion of the insert and an inner portion of the shell within the cavity.

These and other aspects, objects, features, and embodiments will be apparent from the following description and the appended claims.

BRIEF DESCRIPTION OF THE DRAWINGS

The drawings illustrate only example embodiments of grounding for electrical connectors and are therefore not to be considered limiting of its scope, as grounding for electrical connectors may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
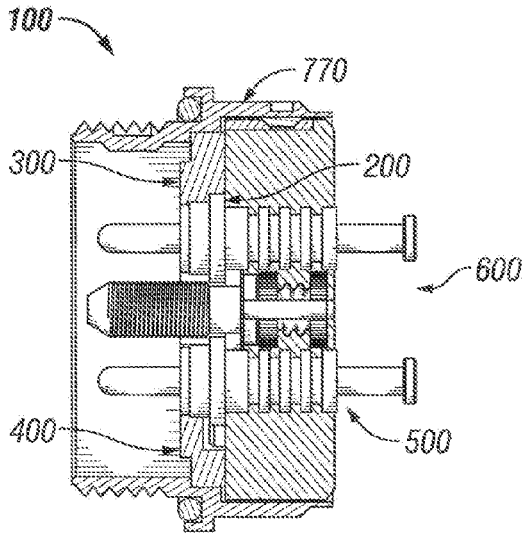
FIGS. 1A-1C shows various views of a portion of an example electrical connector in accordance with certain example embodiments.

The example embodiments discussed herein are directed to systems, apparatuses, and methods of grounding for electrical connectors. Example grounding for electrical connectors can be used in one or more of a number of applications, including but not limited to instrumentation, power, and/or control. Thus, the examples of grounding for electrical connectors described herein are not limited to certain types of electrical connectors.

Any example electrical connector, or portions (e.g., features) thereof, described herein can be made from a single piece (as from a mold). When an example electrical connector portion thereof is made from a single piece, the single piece can be cut out, bent, stamped, and/or otherwise shaped to create certain features, elements, or other portions of a component. Alternatively, an example electrical connector (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, fasten, and/or perform other functions aside from merely coupling. In addition, each component and/or feature described herein can be made of one or more of a number of suitable materials, including but not limited to metal, rubber, and plastic.

A coupling feature (including a complementary coupling feature) as described herein can allow one or more components and/or portions of an electrical connector with example grounding to become mechanically coupled, directly or indirectly, to a portion (e.g., a shell) of an electrical connector. A coupling feature can include, but is not limited to, a portion of a hinge, an aperture, a recessed area, a protrusion, a slot, a spring clip, a tab, a detent, and mating threads. One portion of an example electrical connector can be coupled to another portion of an electrical connector by the direct use of one or more coupling features.

In addition, or in the alternative, a portion of an example electrical connector can be coupled to another portion of the electrical connector using one or more independent devices that interact with one or more coupling features disposed on a component of the electrical connector. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

In one or more example embodiments, electrical connectors using example embodiments are subject to meeting certain standards and/or requirements. For example, the United States Military creates, maintains, and publishes ratings and requirements for electrical connectors. For example, MIL-DTL-55181 is a detail specification that specifies design requirements for a specific electrical connector and addresses such aspects as materials to be used, how a requirement is to be achieved, and how the electrical connector (or a component thereof) is to be fabricated or constructed. Such a standard can establish the requirements for commercial-off-the-shelf (COTS) electrical connectors and/or components thereof.

The description for any component (e.g., face seal, shell) in one or more figures described herein can be considered substantially the same as the description of a corresponding component shown but not described and/or labeled in one or more different (e.g., subsequent) figures. The numbering scheme for any components (or portions of components) of an example embodiment of an electrical connector parallels the numbering scheme for the corresponding components (or portions of components) of a different example embodiment of an electrical connector in other figures. Specifically, similar components between figures have the identical last two or three digits, where the first number (in the case of a three or four digit reference number) can be different.

As described herein, a user can be any person that interacts with an electrical connector with example grounding or a portion thereof. Examples of a user may include, but are not limited to, an engineer, an electrician, a maintenance technician, a mechanic, an operator, a consultant, a contractor, a homeowner, and a manufacturer's representative.

The components of electrical connectors with example grounding described herein can be physically placed in outdoor environments. In addition, or in the alternative, electrical connectors with example grounding can be subject to extreme heat, extreme cold, moisture, humidity, high winds, dust, and other conditions that can cause wear on the electrical connectors with example grounding or components thereof. In certain example embodiments, the components of electrical connectors with example grounding, as well as any coupling (e.g., mechanical, electrical) between such components, are made of materials that are designed to maintain a long-term useful life and to perform when required without mechanical failure.

Example embodiments of grounding of electrical connectors will be described more fully hereinafter with reference to the accompanying drawings, in which example embodiments of grounding of electrical connectors are shown. Grounding of electrical connectors may, however, be embodied in many different forms and should not be construed as limited to the example embodiments set forth herein. Rather, these example embodiments are provided so that this disclosure will be thorough and complete, and will fully convey the scope of grounding of electrical connectors to those of ordinary skill in the art. Like, but not necessarily the same, elements (also sometimes called components) in the various figures are denoted by like reference numerals for consistency. Terms such as "first," "second," "distal," "proximal," "diameter," "top," and "bottom" are used merely to distinguish one component (or part of a component or state of a component) from another. Such terms are not meant to denote a preference or a particular orientation.

Figure 1C:
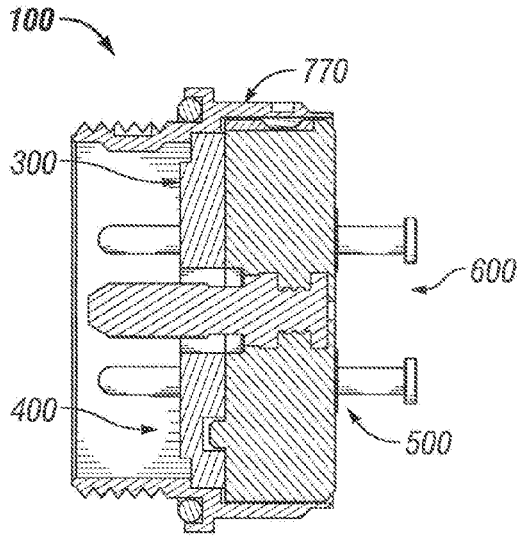
Figure 1B:
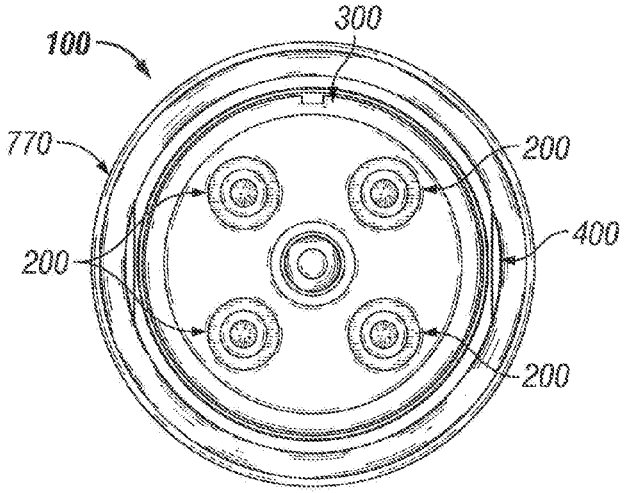

FIGS. 1A-1C show various views of a portion 100 (also called an electrical connector end) of an example electrical connector in accordance with certain example embodiments. Specifically, FIG. 1A shows a transparent cross-sectional side view of the portion 100 of the electrical connector. FIG. 1B shows a top view of the portion 100 of the electrical connector. FIG. 1C shows a cross-sectional side view (not transparent) of the portion 100 of the electrical connector. In one or more embodiments, one or more of the components shown in FIGS. 1A-1C may be omitted, added, repeated, and/or substituted. Accordingly, embodiments of electrical connectors should not be considered limited to the specific arrangements of components shown in FIGS. 1A-1C.

Referring to FIGS. 1A-1C, the portion 100 of the electrical connector can include a subassembly 600 disposed within a shell 770. Subassembly 600 can include subassembly 400 and subassembly 500. Subassembly 400 can include one or more bushings 200 and a face seal 300. Each of these components and/or subassemblies are described in more detail below with respect to FIGS. 2A-6D.

Figure 2A:
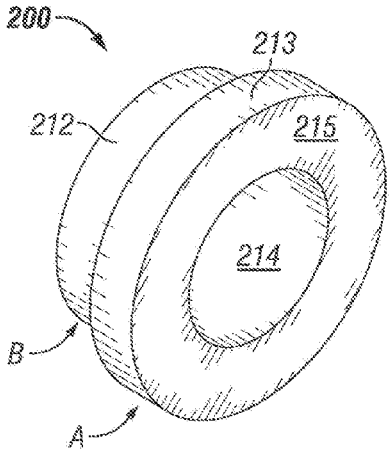
FIGS. 2A-2D show various views of a bushing in accordance with certain example embodiments.
Figure 2B:
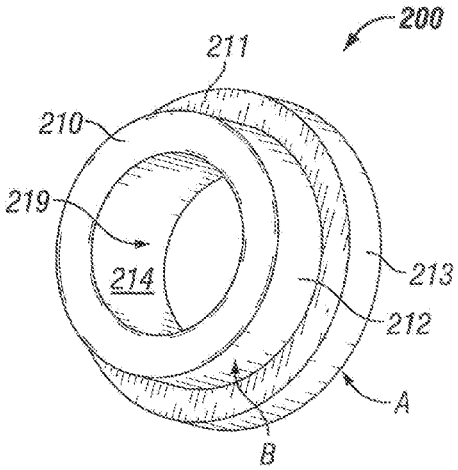
Figure 2C:
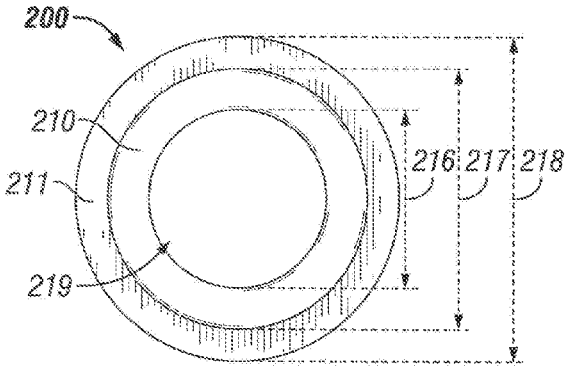
Figure 2D:
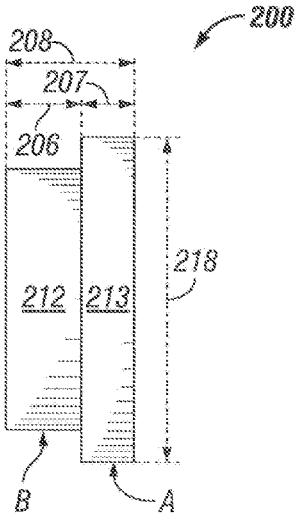

FIGS. 2A-2D shows various views of a bushing 200 in accordance with certain example embodiments. Specifically, FIG. 2A shows bottom perspective view of the bushing 200. FIG. 2B shows a top perspective view of the bushing 200. FIG. 2C shows a top view of the bushing 200. FIG. 2D shows a side view of the bushing 200. In one or more embodiments, one or more of the components shown in FIGS. 2A-2D may be omitted, added, repeated, and/or substituted. Accordingly, embodiments of bushings should not be considered limited to the specific arrangements shown in FIGS. 2A-2D.

Referring to FIGS. 2A-2D, in certain example embodiments, the bushing 200 is made, at least in part, of one or more electrically insulating materials. Examples of such materials can include, but are not limited to, rubber, plastic (including nylon), and ceramic. The bushing 200 can have one or more portions. For example, as shown in FIGS. 2A-2D, the bushing 200 can have portion A and portion B. Portion A and portion B can be positioned adjacent to each other. In this case, portion A is stacked on top of portion B.

Portion A can have one or more walls 213 that form a cavity 219. Portion A can have one or more of a number of shapes. In this example, portion A forms a hollowed cylinder. When viewed cross-sectionally (i.e., from above), the walls 213 of portion A can form a circle (as in this case), a square, a rectangle, a triangle, a hexagon, and/or any of a number of other shapes along its height 207. Portion A can have an inner perimeter (denoted in this case by diameter 216), an outer perimeter (denoted in this case by diameter 218), a bottom 215, a top 211, an outer surface 213, an inner surface 214, and the height 207. Dimensions of some or all of a portion of the bushing 200 can be described using one or more terms appropriate to that shape, and so a diameter as described herein may not be limited to a circular shape.

Similarly, portion B of the bushing 200 can have the same or a different number of walls compared to portion A. In this case, portion B has one wall 212 that also forms cavity 219. Portion A can form the same or a different shape when compared to portion A. In this example, portion B also forms a hollowed cylinder. When viewed cross-sectionally (i.e., from above), the wall 212 of portion B forms a circle in this case throughout the height 206 of portion B. Portion B can have an inner perimeter (denoted in this case by diameter 216), an outer perimeter (denoted in this case by diameter 217), a bottom (hidden from view, but on the same plane as the top 211 of portion A), a top 210, an outer surface 212, an inner surface 214, and the height 206.

Since the bushing 200 in this example only has portion A and portion B, and because portion A and portion B have the same inner perimeter (denoted by diameter 216), the inner surface 214 of portion A and portion B is continuous and substantially uniform along the height 208 of the bushing 200. Thus, the dimensions of the cavity 219 can be substantially uniform along the height 208 of the bushing 200. In this case, the outer perimeter (measured by the diameter 218) of portion A of the bushing 200 is greater than the outer perimeter (measured by the diameter 217) of portion B. In addition, in this case, the height 207 of portion A is less than the height 206 of portion A. As discussed above, portion A and portion B of the bushing 200 can be a single piece or multiple pieces that are mechanically coupled to each other.

Figure 3A:
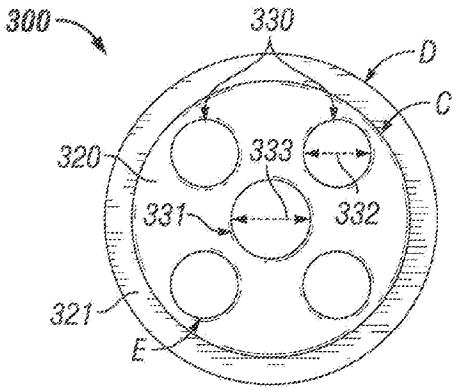
FIGS. 3A-3E show various views of a face seal in accordance with certain example embodiments.
Figure 3B:
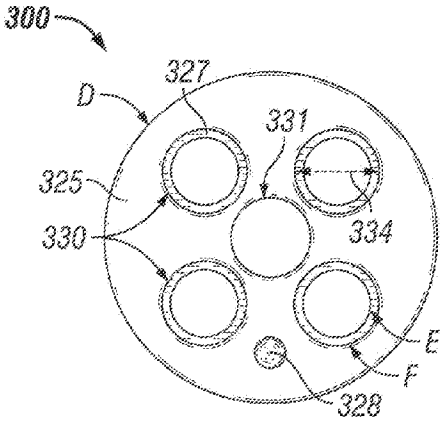
Figure 3C:
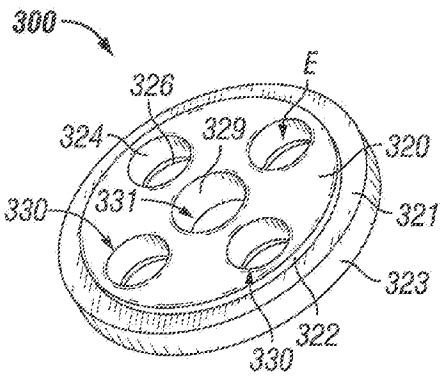
Figure 3D:
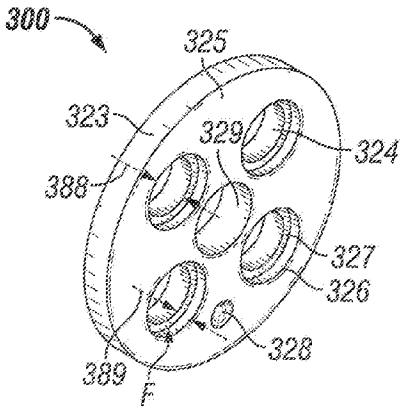
Figure 3E:
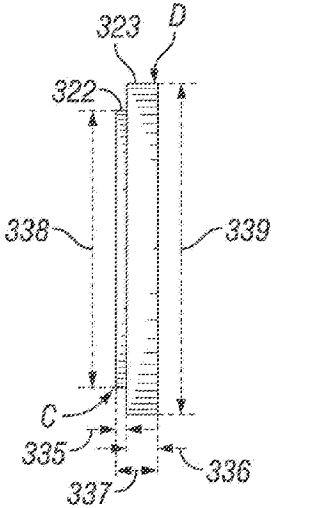

FIGS. 3A-3E show various views of a face seal 300 in accordance with certain example embodiments. Specifically, FIG. 3A shows top view of the face seal 300. FIG. 3B shows a bottom view of the face seal 300. FIG. 3C shows a top perspective view of the face seal 300. FIG. 3D shows a bottom perspective view of the face seal 300. FIG. 3E shows a side view of the face seal 300. In one or more embodiments, one or more of the components shown in FIGS. 3A-3E may be omitted, added, repeated, and/or substituted. Accordingly, embodiments of face seals should not be considered limited to the specific arrangements shown in FIGS. 3A-3E.

Referring to FIGS. 3A-3E, in certain example embodiments, the face seal 300 is an elastomeric device that includes one or more electrically conductive materials. Examples of such electrically conductive materials can include, but are not limited to, silver, copper, carbon, and aluminum. The elastomeric material can allow the face seal 300 to be flexible (e.g., compressible, bendable). Examples of such elastomeric material can include, but are not limited to, synthetic rubbers produced by polymerization of chloroprene, such as neoprene, polychloroprene, urethane, and silicone. In addition, or in the alternative, the elastomeric material can include a butyl compound.

The electrically conductive material can be combined with the elastomeric material in one or more of a number of ways. For example, the electrically conductive material can be mixed with the elastomeric material when both are in liquid form before solidifying and forming the face seal 300 in a mold. As another example, the electrically conductive material can be a coating applied over the elastomeric material after the elastomeric material has solidified. The face seal 300 can also be called by other names, including but not limited to a gasket, a sealing device, a damming device, and an armor stop.

In certain example embodiments, the face seal 300 has a number of portions and/or a number of features. As an example, as shown in FIGS. 3A-3E, the face seal 300 can have portion C and portion D. Portion C and portion D of the face seal 300 can be positioned adjacent to each other. In this case, portion C is stacked on top of portion D. Portion D can have one or more of a number of shapes. In this example, portion D forms a solid cylinder. When viewed cross-sectionally (i.e., from above), portion D can form a circle (as in this case), a square, a rectangle, a triangle, a hexagon, and/or any of a number of other shapes along its height 337. Portion D can have an outer surface 323 forming an outer perimeter (denoted in this case by diameter 339), a bottom 325, a top 321, and the height 337.

Similarly, portion C of the face seal 300 can have the same or a different shape compared to portion D. In this example, portion C also forms a solid cylinder. When viewed cross-sectionally (i.e., from above), portion C can form a circle (as in this case) throughout the height 335 of portion C. Portion C can have an outer surface 322 forming an outer perimeter (denoted in this case by diameter 338), a bottom (hidden from view, but on the same plane as the top 321 of portion D), a top 320, and the height 335. In this case, the outer perimeter (measured by the diameter 339) of portion D of the face seal 300 is greater than the outer perimeter (measured by the diameter 338) of portion C. In addition, in this case, the height 335 of portion C is less than the height 337 of portion D.

A portion of the face seal 300 can include one or more other features. Such other features can include, for example, a coupling feature. For example, a coupling feature 328 can be disposed on the bottom 325 of portion D of the face seal 300. The coupling feature 328 in this case is a recessed area that extends into a portion of the face seal 300. The coupling feature 328 can be used to properly align and/or mechanically couple the face seal 300 with some other component (e.g., the insert 540 as described below with respect to FIGS. 5A-5C) of the electrical connector.

In certain example embodiments, the face seal 300 can have one or more of a number of apertures that traverse therethrough. For example, the face seal 300 can have one aperture 331 disposed in substantially the center of the face seal 300 and four apertures 330 surrounding the aperture 331 in a substantially symmetrical pattern. In this example, the aperture 331 and the apertures 330 are substantially circular (when viewed from above), and the aperture 331 has a slightly larger diameter 333 (bounded by the outer surface 329) than the diameter 332 of each of the four apertures 330. Some of these apertures, such as aperture 331 in FIGS. 3A-3E, can have a diameter 333 (and, thus, an outer perimeter) that is substantially uniform throughout its length 337.

By contrast, one or more apertures (such as the four apertures 330) can have multiple portions. In this example, each aperture 330 can have portion E and portion F. Portion E and portion F of an aperture 330 can be positioned adjacent to each other. In this case, portion E is stacked on top of portion F. Portion F can have one or more of a number of shapes. In this example, portion F forms an open cylinder. When viewed cross-sectionally (i.e., from above), portion F can form a circle (as in this case), a square, a rectangle, a triangle, a hexagon, and/or any of a number of other shapes along its height 389. Portion F can have an outer surface 326 forming an outer perimeter (denoted in this case by diameter 334), a bottom (on the same plane as the bottom 325 of portion D of the face seal), a top (on the same plane as the bottom 327 of portion E), and the height 389.

Similarly, portion E of an aperture 330 can have the same or a different shape compared to portion F. In this example, portion E also forms an open cylinder. When viewed cross-sectionally (i.e., from above), portion E can form a circle (as in this case) throughout the height 388 of portion E. Portion E can have an outer surface 324 forming an outer perimeter (denoted in this case by diameter 332), a bottom 327, a top (on the same plane as the top 320 of portion C of the face seal), and the height 388. In this case, the outer perimeter (measured by the diameter 334) of portion F of an aperture 330 is greater than the outer perimeter (measured by the diameter 332) of portion E. In addition, in this case, the height 389 of portion F is less than the height 388 of portion E.

Each aperture in the face seal 300 described herein is shown and described as being cylindrical or conical (i.e., circular when viewed from a horizontal cross section). Alternatively, or in addition, the apertures can have one or more other shapes, viewed in two or three dimensions. For example, one or more apertures of the face seal 300 may have one shape (e.g., cube), while one or more apertures of the face seal 300 can have another shape (e.g., cylinder). Examples of such shapes, when viewed in a two dimensional space, include but are not limited to a circle, an ellipse, a square, a rectangle, a hexagon, an octagon, and five-point star.

Figure 4B:
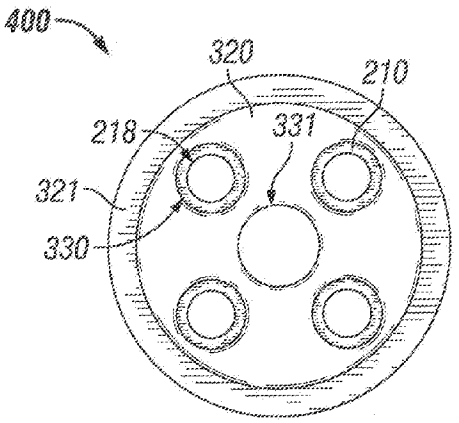
FIGS. 4A-4C show various views of a subassembly of an example electrical connector that includes the bushing of FIGS. 2A-2D and the face seal of FIGS. 3A-3E in accordance with certain example embodiments.
Figure 4C:
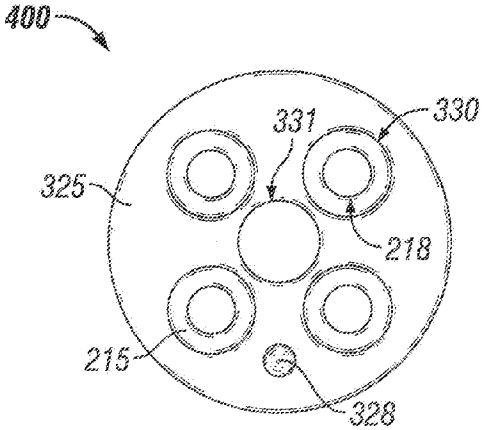
Figure 4A:
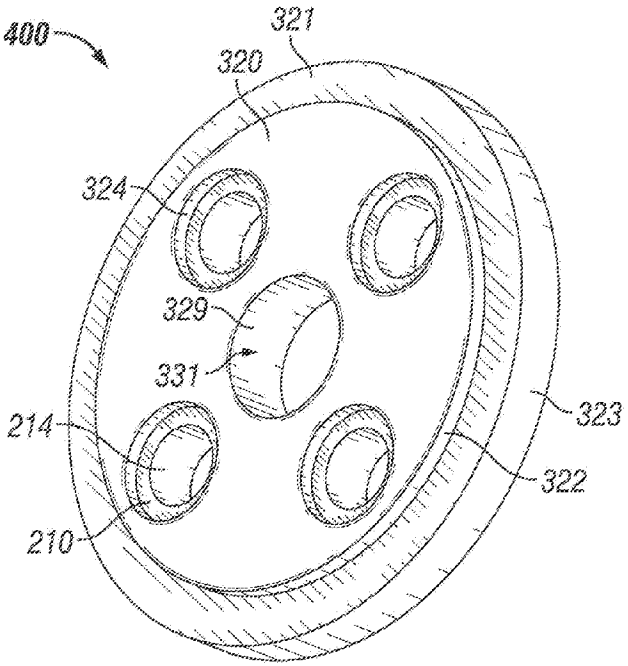

FIGS. 4A-4C show various views of the subassembly 400 of an example electrical connector that includes the bushing 200 of FIGS. 2A-2D and the face seal 300 of FIGS. 3A-3E in accordance with certain example embodiments. FIG. 4A shows a top perspective view of the subassembly 400. FIG. 4B shows a top view of the subassembly 400. FIG. 4C shows a bottom view of the subassembly 400. In one or more embodiments, one or more of the components shown in FIGS. 4A-4C may be omitted, added, repeated, and/or substituted. Accordingly, embodiments of subassemblies of an electrical connector should not be considered limited to the specific arrangements shown in FIGS. 4A-4C.

Referring to FIGS. 2A-4C, a bushing 200 is inserted into each of the apertures 330 in the face seal 300. In this case, each bushing 200 is inserted from the bottom 325 of the face seal 300. In such a case, the shape and/or size of one or more portions of the bushing 200 can be the same as the shape and/or size of one or more portions of an aperture 330. In this example, portion A of each bushing 200 is cylindrical and has a height 207 and an outer perimeter (denoted by diameter 218) that is substantially the same as, or slightly less than, the height 389 and the outer perimeter (denoted by diameter 334) of the cylindrically-shaped portion F of each aperture 330 of the face seal 300.

Similarly, portion B of each bushing 200 is cylindrical and has an outer perimeter (denoted by diameter 217) that is substantially the same as, or slightly less than, the outer perimeter (denoted by diameter 332) of the cylindrically-shaped portion E of each aperture 330 of the face seal 300. The height 206 of each bushing 200 can be the same as, or different than, the height 388 of portion E of each aperture 330 of the face seal 300. For example, in this case, the height 206 of each bushing 200 is less than the height 388 of portion E of each aperture 330 of the face seal 300. As a result, the height 208 of a bushing 200 can be the same as, or different (e.g., less, as in this example) than the height 337 of the face seal 300.

The subassembly 400 can be assembled in one or more of a number of ways. For example, one or more of the bushings 200 can be post-inserted into an aperture 330 of the face seal 300. In other words, a bushing 200 can be inserted into an aperture 330 of the face seal 300 once the face seal 300 has been formed. As another example, one or more bushings 200 can be overmolded by the face seal 300 as the face seal 300 changes from liquid to solid form.

Figure 5B:
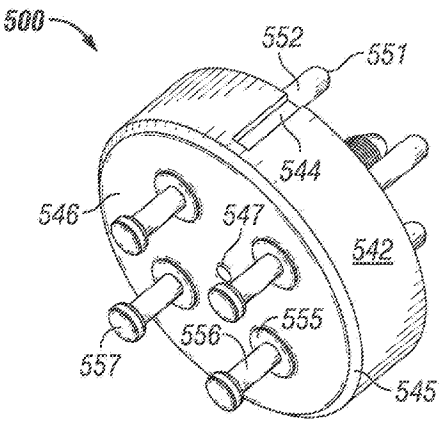
FIGS. 5A-5C show various views of a different subassembly of an electrical connector in accordance with certain example embodiments.
Figure 5C:
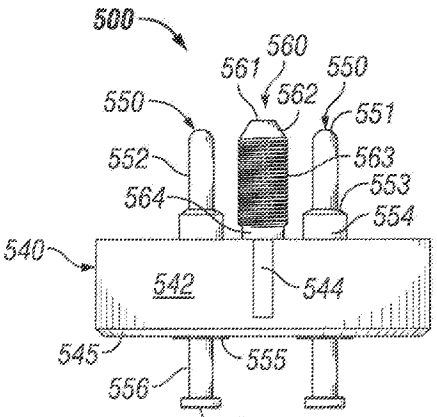
Figure 5A:
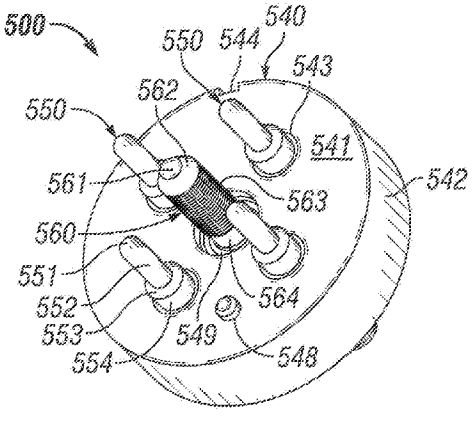

FIGS. 5A-5C show various views of a different subassembly 500 of an electrical connector in accordance with certain example embodiments. FIG. 5A shows a top perspective view of the subassembly 500. FIG. 5B shows a bottom perspective view of the subassembly 500. FIG. 5C shows a side view of the subassembly 500. In one or more embodiments, one or more of the components shown in FIGS. 5A-5C may be omitted, added, repeated, and/or substituted. Accordingly, embodiments of subassemblies of an electrical connector should not be considered limited to the specific arrangements shown in FIGS. 5A-5C.

Referring to FIGS. 5A-5C, the subassembly 500 can include an insert 540, at least one connector pin 550, and a jack screw 560. The insert 540 can have a distal end 541, a proximal end 546, and at least one side 542. The number of sides 542 of the insert 540 can be based on the cross-sectional shape of the insert 540. In this case, the cross-sectional shape of the insert 540 is substantially circular, but can have one or more of a number of other shapes, including but not limited to an oval, a square, a triangle, and a hexagon. The cross-sectional shape of the insert 540 (especially the distal end 541) can be substantially the same as the cross-sectional shape of portion D of the face seal 300.

In certain example embodiments, the distal end 541 of the insert 540 can include one or more coupling features 548. Such coupling features 548 can be complementary to the coupling features 328 disposed on the bottom 325 of portion D of the face seal 300. For example, if the coupling feature 328 is a recessed area that extends into a portion of the face seal 300, then the coupling feature 548 can be a protrusion having a size, shape, and location on the distal end 541 of the insert 540 that allows the coupling feature 328 and the coupling feature 548 to mechanically couple to each other while putting the face seal 300 in a particular position relative to the insert 540.

One or more portions of the side 542 of the insert 540 can also have one or more of a number of coupling features 544. Such coupling features 544 can be used to couple and/or align the insert 540 with one or more other components of an electrical connector. In this example, the coupling feature 544 is a slot that extends from the distal end 541 of the insert 540 toward the proximal end 546 without completely traversing the height of the insert 540. In such a case, the coupling feature 544 can be used with a complementary coupling feature disposed on the shell 770 to align the insert 540 with and/or mechanically couple the insert 540 to the shell 770.

The insert 540 can include one or more apertures that traverse through some or all of the insert 540. For example, there can be an aperture 547 disposed in the approximate center of the insert 540 and into which the jack screw 560, described below, can be disposed. In such a case, the jack screw 560 can be partially embedded in the insert 540, and so the aperture 547 can be smaller (like a relief hole) at the proximal end 546 compared to the distal end 541. In addition, or in the alternative, the aperture 547 can have an outer perimeter that is larger than the outer perimeter of the jack screw 560. In such a case, there can be a gap 549 between the jack screw 560 and the distal end 541 of the body 540.

As another example, there can be one or more apertures (hidden from view by the connector pins 550, described below) disposed in various locations of the insert 540. In such a case, if there are multiple apertures, such apertures can be spaced substantially equidistantly around the aperture 547 in which the jack screw 560 is disposed. In certain example embodiments, one or more of the apertures can have an outer perimeter that is larger than the outer perimeter of the connector pins 550. In such a case, there can be a gap 543 between a connector pin 550 and the distal end 541 of the body 540.

The aperture 547 for the jack screw 560 and/or the apertures for the connector pins 550 can be pre-formed when the insert 540 is created. In such a case, the jack screw 560 and/or the connector pins 550 can be post-inserted into the respective apertures of the insert 540. Alternatively, the body 540 can be overmolded around the jack screw 560 and/or the connector pins 550. The insert 540 can be made of one or more of a number of electrically non-conductive materials, including but not limited to plastic, rubber, and ceramic. Additionally or alternatively, the insert 540 can include one or more other features. For example, as shown in FIGS. 5A-5C, the insert 540 can include a beveled edge 545 around some or all of the perimeter of the proximal end 546.

In certain example embodiments, the one or more connector pins 550 are made of one or more of a number of electrically conductive materials. Such materials can include, but are not limited to, copper and aluminum. Each connector pin 550 is configured to mechanically and electrically couple to, at one (e.g., proximal) end, one or more electrical conductors, and to mechanically and electrically couple to, at the opposite (e.g., distal) end, another portion of an electrical connector. Any of a number of configurations for the proximal end and the distal end of a connector pin can exist and are known to those of ordinary skill in the art. The configuration of the proximal end and/or the distal end of one connector pin 550 of an electrical connector can be the same as or different than the configuration of the proximal end and/or the distal end of the remainder of connector pins 550 of the electrical connector.

Each connector pin 550 can be elongated, such that some middle portion is disposed within an aperture of the insert 540, while a portion of the distal and proximal end extends beyond (or is accessible from) the distal end 541 and the proximal end 546, respectively, of the insert 540. For example, in this case, the proximal end of the connector pin 550 can include a stem 556 capped by an end cap 557. At the base of the proximal end can be disposed a flange 555 which abuts against the proximal end 546 of the insert 540. In such a case, the flange 555 can act as a stop and prevent the connector pin 550 from being inserted into the insert 540 beyond a certain point.

As another example, as shown in FIGS. 5A-5C, the distal end of the connector pin 550 can include a connector end 552 having a tip 551 and that extends from a base 554 through a transition section 553. The tip 551 can be a solid piece, giving the distal end of the connector pin 550 a male configuration. Alternatively, the tip 551 can have an aperture, where the aperture continues through some or all of the connector end 552, giving the distal end of the connector pin 550 a female configuration. The shape and/or size of the base 554 (and/or any other part of the distal end) of the connector pin 550 can be substantially the same as, or slightly less than, the shape and/or size of the aperture in the insert 540 in which the connector pin 550 is disposed. In the case where the shape and/or size of the base 554 is less than the shape and/or size of the aperture in the insert 540, a gap 543 is created between the connector pin 550 and the insert 540.

The jack screw 560 is a part of the subassembly 500 that can act as a standoff and/or attachment feature with respect to some other portion of an electrical connector. The jack screw 560 can be disposed, at least in part, in the aperture 547 of the insert and extend beyond the proximal end 546 and/or the distal end 541 of the insert 540. In this case, the jack screw 560 extends away from the distal end 541 of the insert 540. Toward the distal end of the jack screw 560 (for at least the portion of the jack screw 560 that protrudes beyond the insert 540) can be a base 564 that has a coupling feature 563 disposed on at least part of its outer surface. The distal end 561 of the base 564 can be flattened and have an outer perimeter that is smaller than the outer perimeter of the base 564. In such a case, a transition section 562 can connect the distal end 561 to the base 564. The coupling feature 563 disposed on the outer surface of the base 564 in this case is mating threads, and can be used to couple to a complementary coupling feature disposed on some other portion of the electrical connector.

As discussed above, the base 564 of the jack screw 560 can have an outer perimeter that is substantially the same as, or smaller than, the outer perimeter of the aperture 547 in the insert 540. If the outer perimeter that is smaller than the outer perimeter of the aperture 547 in the insert 540, than a gap 549 exists between the jack screw 560 and the insert 540. The jack screw 560 can be made of one or more of a number of materials, including but not limited to metal, rubber, and plastic.

Figure 6A:
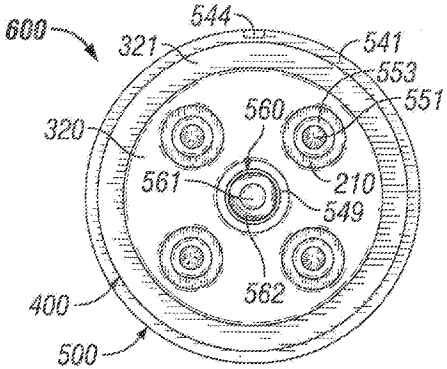
FIGS. 6A-6D show various views of a portion of yet another subassembly of an example electrical connector in accordance with certain example embodiments.
Figure 6C:
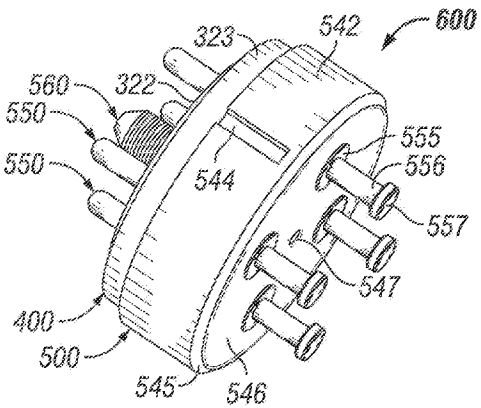
Figure 6B:
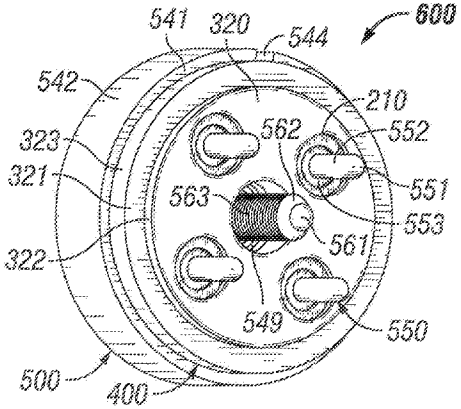
Figure 6D:
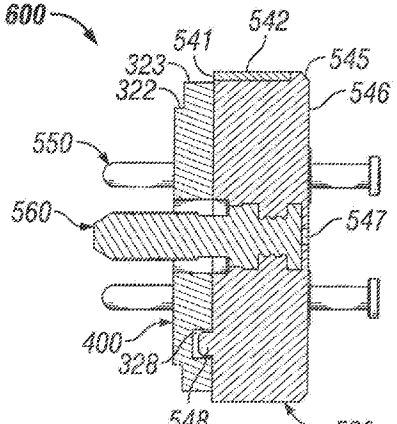

FIGS. 6A-6D show various views of a portion of yet another subassembly 600 of an example electrical connector in accordance with certain example embodiments. Specifically, FIGS. 6A-6D show the subassembly 500 of FIGS. 5A-5C coupled to the subassembly 400 of FIGS. 4A-4C. FIG. 6A shows a top view of the subassembly 600. FIG. 6B shows a top perspective view of the subassembly 600. FIG. 6C shows a bottom perspective view of the subassembly 600. FIG. 6D shows a cross-sectional side view of the subassembly 600. In one or more embodiments, one or more of the components shown in FIGS. 6A-6D may be omitted, added, repeated, and/or substituted. Accordingly, embodiments of subassemblies of an electrical connector should not be considered limited to the specific arrangements shown in FIGS. 6A-6D.

Referring to FIGS. 1A-6D, the cross-sectional shape of the face seal 300 (e.g., portion D of the face seal 300) can be substantially the same as, but slightly smaller than, the cross-sectional shape of the distal end 541 of the insert 540. The inner surface of the coupling feature 544 (in this case, a slot) disposed on the side 542 of the insert 540 can be recessed to be approximately aligned with the outer surface 323 of portion D of the face seal 300. Further, the coupling feature is coupled to (in this case, disposed within) the coupling feature 328 of the face seal 300. In addition, the shape and size of the base 554 of a connector pin 550 can be substantially the same as the shape and size of the aperture 219, bounded by inner surface 214, of a bushing 200. Further, the shape and size of the aperture 331, as denoted by diameter 333, of the face seal 300 can be substantially the same as the shape and size of the gap 549 between the jack screw 560 and the insert 540.

Figure 7C:
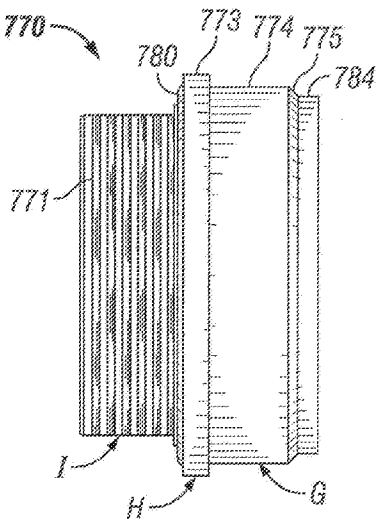
FIGS. 7A-7C shows a connector shell in accordance with certain example embodiments.
Figure 7B:
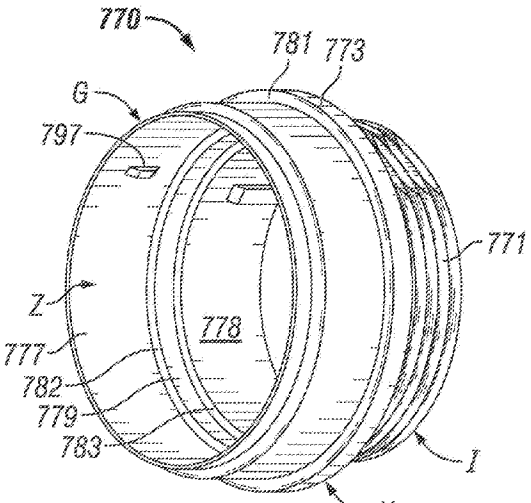
Figure 7A:
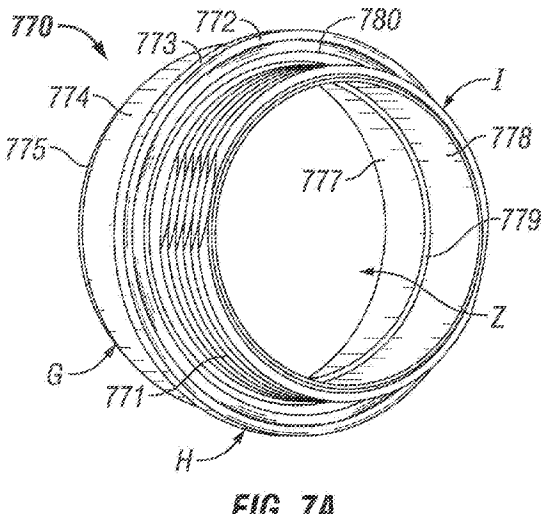
Figure 15:
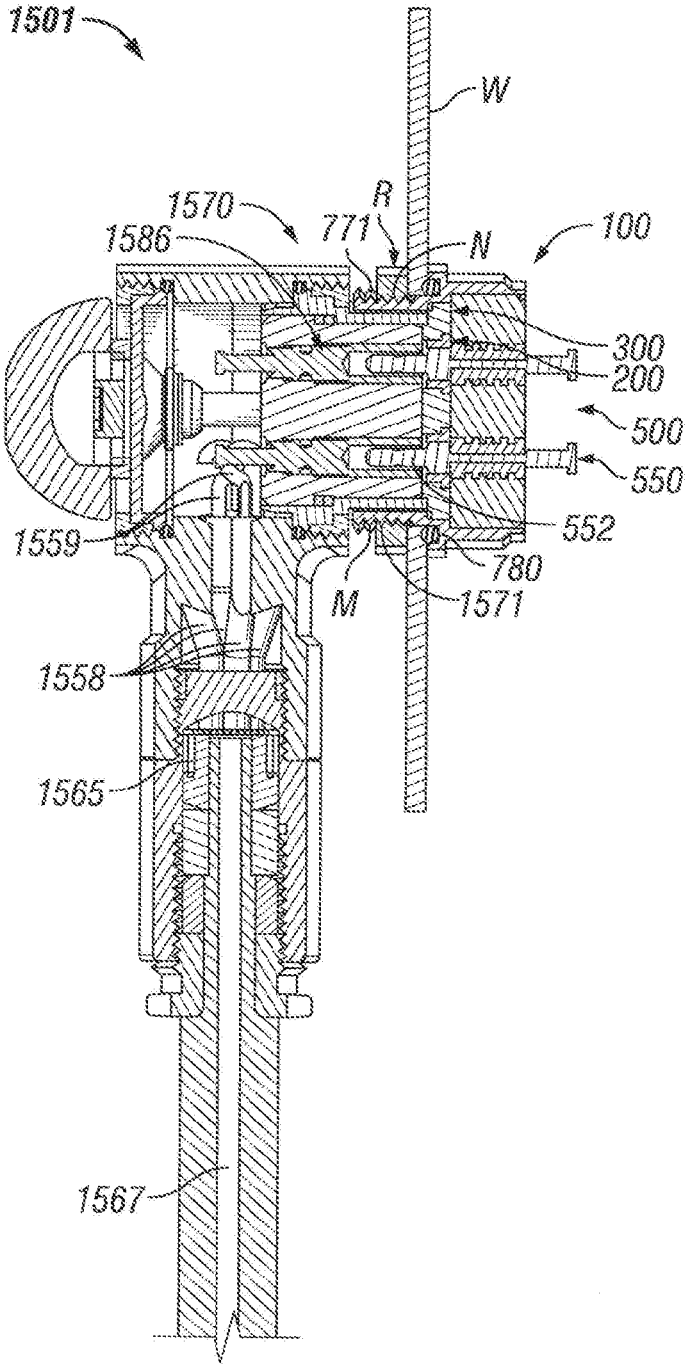
FIGS. 15 and 16 each shows a cross-sectional side view of electrical connectors in accordance with certain example embodiments.
Figure 16:
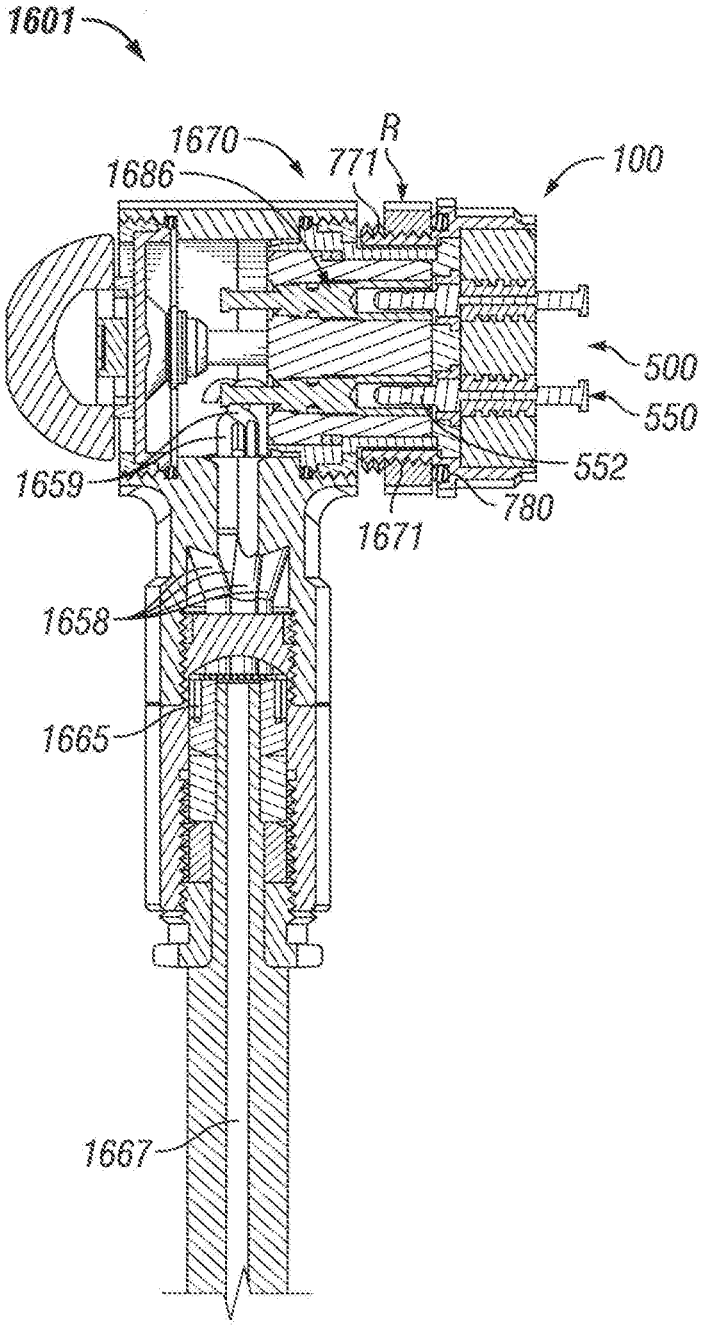

FIGS. 7A-7C shows a connector shell 770 in accordance with certain example embodiments. FIG. 7A shows a front perspective view of the connector shell 770. FIG. 7B shows a rear perspective view of the connector shell 770. FIG. 7C shows a side view of the connector shell 770. FIG. 15 shows a cross-sectional side view of a system 1501 that includes electrical connector end 100 (which, in turn, includes connector shell 770) in accordance with certain example embodiments. FIG. 16 shows a cross-sectional side view of a system 1601 that includes electrical connector end 100 (which, in turn, includes connector shell 770) in accordance with certain example embodiments. In one or more embodiments, one or more of the components shown in FIGS. 7A-7C, 15, and 16 may be omitted, added, repeated, and/or substituted. Accordingly, embodiments of connector shells should not be considered limited to the specific arrangements shown in FIGS. 7A-7C, 15, and 16.

Referring to FIGS. 1A-7C, 15, and 16, the connector shell 770 (or, more simply, the shell 770) can be used to house some or all of the components of the subassembly 600 (or embodiments thereof) of FIGS. 6A-6D. The shell 770 can also be used to connect to some other component (e.g., another shell) of an electrical connector, as shown in FIG. 16, and/or to an enclosure (e.g., a junction box, a panel), as shown in FIG. 15. The shell 770 can be made of one or more of a number of electrically conductive materials. In certain example embodiments, the shell 770 can have one or more of a number of portions. For example, as shown in FIGS. 7A-7C, the shell can have 3 portions (e.g., portion G, portion H, portion I). Each portion of the shell can be adjacent to at least one other portion of the shell. As described below, each portion of the shell 770 can have one or more of a number of features.

Portion G of the shell 770 can have at least one wall (in this case, having inner surface 777) that forms a cavity Z. Disposed on the inner surface 777 of the wall can be one or more coupling features 797 that can be configured to mechanically couple to the coupling feature 544 of the insert 540. In this example, the coupling feature 797 is a protrusion that extends inward from the inner surface 777. The protrusion can have a shape and size that corresponds to the shape and size of the coupling feature 544 of the insert 540 such that the subassembly 600 has a certain position and orientation within the shell 770. Portion G can also have one or more outer surfaces of the wall. In this example, portion G can have outer surface 774, outer surface 784, and transition section 775 positioned inbetween. Outer surface 774 can have the same, or a different (e.g., greater, as shown), outer perimeter than outer surface 784. The inner surface 777 (or, more specifically, the outer perimeter of the cavity Z) can be substantially uniform along the height of portion G. In certain example embodiments, the inner surface 777 can have a shape and size that is substantially the same as the shape and size of the insert 540.

Portion H of the shell 770 can also have at least one wall. In this case, the wall of portion H has an inner surface 779 and an outer surface 773. The outer perimeter formed by the inner surface 779 of portion H can be the same as, or different (in this case, smaller) than the outer perimeter formed by the inner surface 777 of portion G. When the outer perimeter formed by the inner surface 779 of portion H is different than the outer perimeter formed by the inner surface 777 of portion G, transition section 782 can be disposed therebetween. Similarly, the outer perimeter of the outer surface 773 of portion H can be the same as, or different (in this case, larger) than the outer perimeter formed by any of the outer surfaces of portion G, When the outer perimeter formed by the outer surface 773 of portion H is different than the outer perimeter formed by the outer surface 774 of portion G adjacent to outer surface 773, transition section 781 can be disposed therebetween. In certain example embodiments, the inner surface 779 can have a shape and size that is substantially the same as the shape and size of the face seal 300. In such a case, the face seal 300 can abut against the transition section 783 and create a liquid-tight seal between the face seal 300 and the shell 770.

Portion H can also include a channel (hidden from view) disposed on the outer surface 773. The channel can be disposed over some or all of the outer perimeter of portion H. The channel can have a shape and size sufficient to receive the sealing member 780, shown in FIGS. 7A-7C disposed in the channel. The sealing member 780 (e.g., gasket, o-ring) can be made of one or more of a number of flexible materials, including but not limited to rubber and nylon. The sealing member 780 can abut against another component (e.g., another shell) of an electrical connector (as shown in FIG. 16) and/or to an enclosure (e.g., a junction box, a panel) (as shown in FIG. 15) and create a liquid-tight seal between the shell 770 and that other component and/or device. For example, as shown in the system 1601 of FIG. 16, electrical connector end 100 of FIGS. 1A-1C is directly coupled to complementary connector end 1600, and so sealing member 780 abuts against the shell 1670 of the complementary connector end 1600 and creates a liquid-tight seal between shell 770 and shell 1670, In such a case, the other component and/or device can be electrically conductive. Since the shell 770 is also electrically conductive, a path for a ground current (also called a ground path) can flow between the shell 770 and the other component and/or enclosure. For example, in the system 1501 of FIG. 15, the complementary connector end 1500 includes a number of complementary connector pins 1586 (also called by other names, such as pin receivers) that are coupled to the pins 550 of the electrical connector end 100. A shielded cable 1567 having a ground shield 1565 in this case is electrically coupled to the shell 1570 of the complementary connector end 1500. Consequently, the ground shield 1565 is electrically coupled to the electrically conductive face seal 300 of the electrical connector end 100. Thus, by incorporating the example face seal 300 with the electrical connector end 100, and by electrically isolating the face seal 300 from the connector pins 550 using the example bushings 200, a ground path can be established for any current flowing through the face seal 300 and the shield 1565.

Portion I of the shell 770 can also have at least one wall. In this case, the wall of portion I has an inner surface 778 and an outer surface 771. The outer perimeter formed by the inner surface 778 of portion I can be the same as, or different (in this case, smaller) than the outer perimeter formed by the inner surface 779 of portion H, When the outer perimeter formed by the inner surface 779 of portion H is different than the outer perimeter formed by the inner surface 778 of portion I, transition section 783 can be disposed therebetween. Similarly, the outer perimeter of the outer surface 773 of portion H can be the same as, or different (in this case, larger) than the outer perimeter formed by the outer surface 771 of portion I. When the outer perimeter formed by the outer surface 773 of portion H is different than the outer perimeter formed by the outer surface 771 of portion I adjacent to outer surface 773, transition section 772 (which can include the channel that receives the sealing member 780) can be disposed therebetween.

The outer surface 771 of portion I can have one or more coupling features disposed thereon. For example, as shown in FIGS. 7A-7C, the coupling feature disposed on the outer surface 771 of portion I can be mating threads. In such a case, a panel, junction box, or other enclosure can have an aperture, shaped and sized substantially the same as the shape and size of portion I of the shell 770, where the aperture has complementary mating threads disposed on its outer surface. For example, the system 1501 of FIG. 15 shows electrical connector end 100 coupled to a complementary connector end 1500 through an enclosure wall W of an enclosure. In such a case, the coupling features (in this case, mating threads) disposed on the outer surface 771 of portion I protrude through and couple to an aperture in the enclosure wall W and couple to a rotating sleeve R of the complementary connector end 1500, where the rotating sleeve R has coupling features (also mating threads in this case) disposed on its inner surface 1571 so that electrical connector end 100 couples to complementary connector end 1500. In such a case, the sealing member 780 abuts against the enclosure wall W to create a liquid-tight seal between the shell 770 and the enclosure wall W. When the electrical connector end 100 coupled to the complementary connector end 1500, In some cases, the aperture in the enclosure wall W is without mating threads or other coupling features. As shown in FIGS. 15 and 16, the grounding path for the ground shield is shown. For example, in FIG. 15, the shield 1565 is electrically coupled to the shell. Further, the panel, junction box, or other enclosure can enclose at least one complementary connector pin that electrically and mechanically couple to the connector pins 550 of the subassembly 600.

Figure 8:
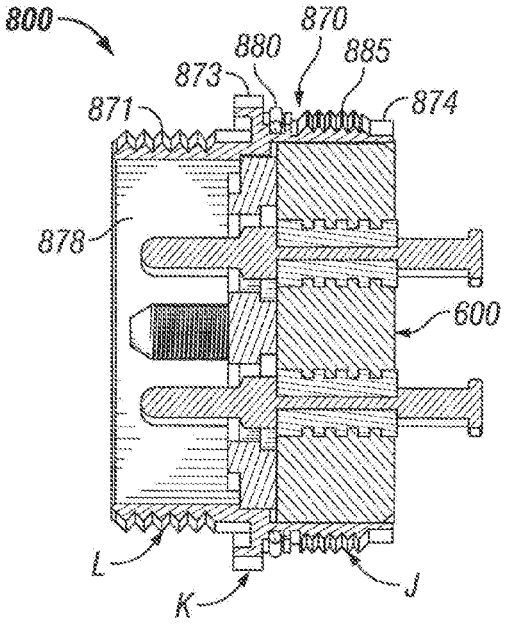
FIG. 8 shows a cross-sectional side view of a portion of another example electrical connector in accordance with certain example embodiments.

FIG. 8 shows a cross-sectional side view of a portion 800 of another example electrical connector in accordance with certain example embodiments. In one or more embodiments, one or more of the components shown in FIG. 8 may be omitted, added, repeated, and/or substituted. Accordingly, embodiments of connector shells should not be considered limited to the specific arrangements shown in FIG. 8.

Referring to FIGS. 1A-8, the portion 800 of the electrical connector of FIG. 8 is substantially the same as the portion 100 of the electrical connector of FIGS. 1A-1C, except as described below. Specifically, the subassembly 600 of FIGS. 1-6D are substantially the same as the subassembly 600 of FIG. 8, but the shell 770 of FIGS. 1-7C has some differences compared to the shell 870 of FIG. 8. The shell 870 of FIG. 8 has portion J, portion K, and portion L, which correspond to portion G, portion H, and portion I, respectively, of the shell 770 of FIGS. 1-7C.

Portion K of the shell 870 has a channel into which a sealing member 880 is disposed, but in this case, the channel is positioned adjacent to portion J as opposed to portion L. In addition, portion J has one or more coupling features 885 disposed on at least a portion of the outer surface 874 of the wall. In this example, as in FIGS. 1A-1C, the subassembly 600 is disposed within the cavity Z of the shell 870. In certain example embodiments, the inner surface 879 can have a shape and size that is substantially the same as the shape and size of the face seal 300. In such a case, the face seal 300 can abut against the transition section 883 between the inner surface 878 of portion L and the inner surface 879 of portion K to create a liquid-tight seal between the face seal 300 and the shell 870.

Figure 9:
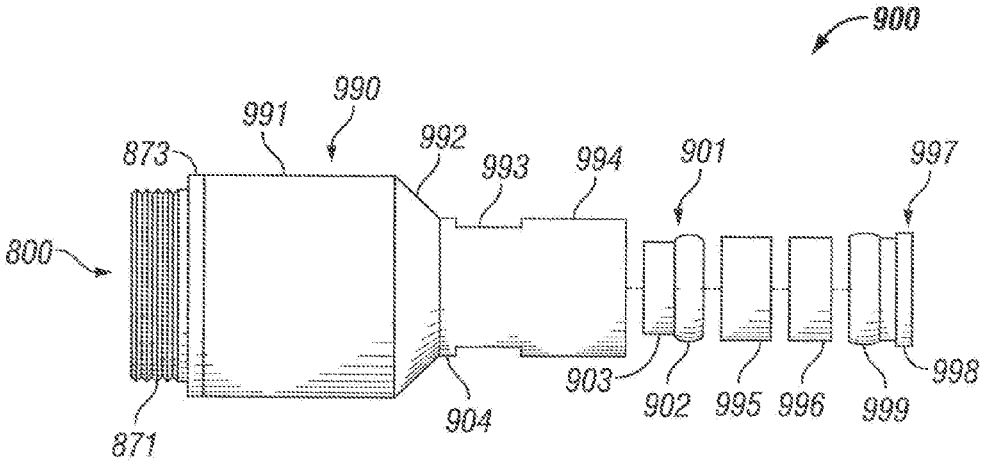
FIG. 9 shows an exploded side view of another portion of the example electrical connector of FIG. 8 in accordance with certain example embodiments.

FIG. 9 shows an exploded side view of another portion 900 of the example electrical connector of FIG. 8 in accordance with certain example embodiments. In one or more embodiments, one or more of the components shown in FIG. 9 may be omitted, added, repeated, and/or substituted. Accordingly, embodiments of a portion of an electrical connector should not be considered limited to the specific arrangements shown in FIG. 9.

Referring to FIGS. 1A-9, the portion 900 includes a second shell 990 that is mechanically coupled to the shell 870. Specifically, in this case, the shell 990 is mechanically coupled to the coupling feature 885 disposed on the outer surface 874 of potion J of the shell 870. The shell 990 can include multiple portions. In this example, the shell 990 includes a distal portion having outer surface 991, where the outer perimeter of the outer surface 991 is substantially the same as the outer perimeter of the outer surface 873 of portion K of the shell 870.

The shell 990 can also include a proximal portion having, from distal end to proximal end, an outer surface 904, an outer surface 993, and an outer surface 994, where each outer surface can have the same and/or a different outer perimeter compared to the outer perimeter of each of the other parts of the proximal portion. Positioned between the distal portion and the proximal portion of the shell 990 is a transition section 992.

Each portion of the shell 990 can have a cavity traversing therethrough. Disposed inside at least part of the cavity of the proximal portion of the shell 990 can be a cable receiving assembly. In this case, the cable receiving assembly can include a ferrule 901, a grommet 995, a ferrule 996, and a nut 997. The ferrule 901 can have a portion 903 and a portion 902. Similarly, the nut 997 can have a portion 998 and a portion 999. More details about the cable receiving assembly are provided below with respect to FIGS. 10A and 10B.

Figure 10A:
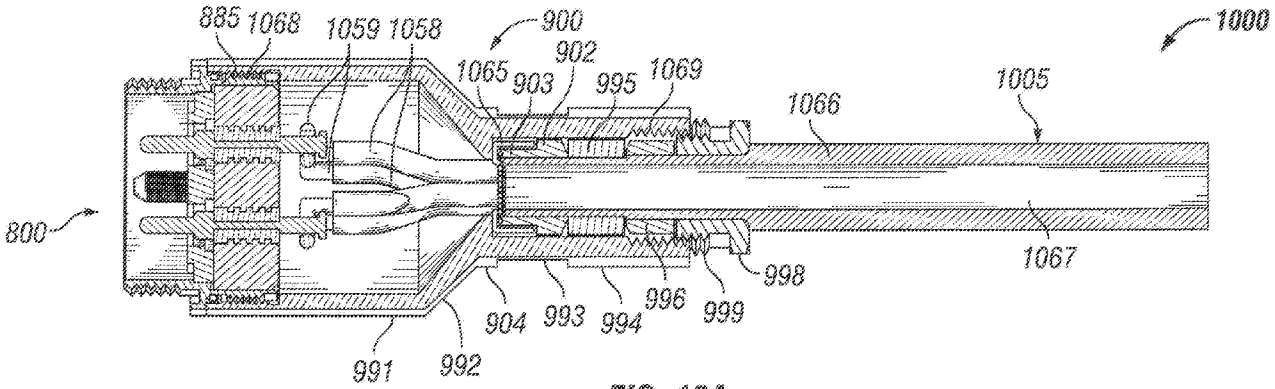
FIGS. 10A and 10B shows cross sectional side views of an electrical connector that includes the portion shown in FIG. 9 in accordance with certain example embodiments.
Figure 10B:
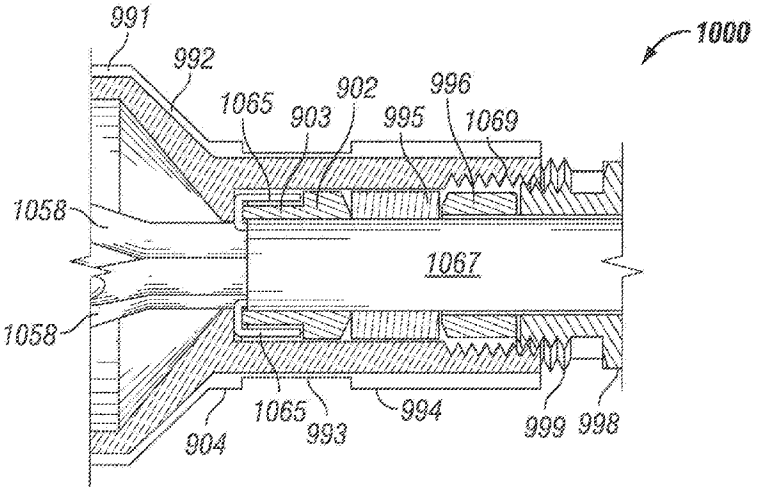

FIGS. 10A and 10B shows cross-sectional side views of an electrical connector 1000 that includes the portion 900 shown in FIG. 9 in accordance with certain example embodiments. Specifically, FIG. 10A shows a cross-sectional side view of the electrical connector 1000, and FIG. 10B shows a cross-sectional side view detailing the cable receiving assembly. In one or more embodiments, one or more of the components shown in FIGS. 10A and 10B may be omitted, added, repeated, and/or substituted. Accordingly, embodiments of an electrical connector should not be considered limited to the specific arrangements shown in FIGS. 10A and 10B.

Referring to FIGS. 1A-10B, a shielded cable 1067 is disposed within a sleeve 1066. The sleeve 1066 can be a cable jacket (e.g., a rubber coating), a conduit, and/or some other protective component of the cable 1067 and/or device inside of which the cable 1067 can be disposed. The sleeve 1006 can be mechanically coupled to one or more parts (e.g., the nut 997) of the cable receiving assembly. In some cases, a liquid-tight seal can be formed between the sleeve 1006 and the cable receiving assembly.

The cable 1067 can include one or more conductors 1059. Each conductor 1059 can be made of one or more of a number of electrically conductive materials. A conductor 1059 can be surrounded by insulation 1058 that is electrically non-conductive. The insulation 1058 can be removable by a user to expose the conductor 1059 within. The exposed conductor 1059 can be electrically and mechanically coupled to one or more parts (e.g., the stem 556) of the proximal end of a connector pin 550.

The cable 1067 can also include a shield 1065. The shield 1065 can be an individual strand among the wires 1058 of the cable or, more commonly, a thin layer that surrounds some or all of the conductors 1059 in the cable 1067. The shield 1065 can be made of electrically conductive material. The shield 1065 can be used to reduce electrical noise and improve the quality of the power flowing through the conductors 1059 and/or to reduce the amount of electromagnetic radiation emanating from the conductors 1059 when power flows through the conductors 1059. The shield can be made of one or more of a number of electrically conductive materials, including but not limited to aluminum, copper, and a polymer.

In certain example embodiments, the shield 1065 is terminated within the example electrical connector. In this case, as shown in FIGS. 10A and 10B, the shield 1065 is exposed and terminated (disposed) between the portion 903 of the ferrule of the cable receiving assembly and the inner surface (opposite the outer surface 904 and the outer surface 993) of the proximal portion of the shell 990. Since the shell 990 is made of electrically conductive material, any current flowing through the shield 1065 is transferred to the shell 990.

Similarly, since the shell 990, also is mechanically coupled to the shell 870 through, for example, the coupling features 1068 of the shell 990 and the complementary coupling features 885 of the shell 870, any current flowing through the shell 990 from the shield 1065 is transferred to the shell 870. Consequently, since the example face seal 300, also made of electrically conductive material, abuts against the shell 870, any current flowing through the shell 870 as received from the shell 990 is transferred to the face seal 300. Thus, by incorporating the example face seal 300 with the electrical connector, and by electrically isolating the face seal 300 from the connector pins 550 using the example bushings 200, a ground path can be established for any current flowing through the shield 1065.

The portion 902 of the ferrule 901 provides a boundary against which the exposed shield 1065 is disposed, helping to improve the contact between the shield 1065 and the shell 990. The ferrule 901 can be put in a certain position within the cavity of the shell 990 by the use of the grommet 995, the ferrule 996, and the nut 997, as shown in FIGS. 10A and 10B. In certain example embodiments, the ferrule 901 is made of one or more of a number of electrically conductive materials. Further, the ferrule 901 (as well as the grommet 995 and the ferrule 996) can be secured within cavity of the shell 990 by use of the portion 999 of the nut 997. In such a case, the portion 999 of the nut can have one or more of a number of coupling features (e.g., mating threads) that mechanically couple to complementary coupling features 1069 disposed on the inner surface of the proximal portion of the shell 990, as shown in FIGS. 10A and 10B.

Portion 998 of the nut 997 can have a shape and/or size that prevents the cable receiving assembly from being inserted too far into the cavity of the shell 990. Portion 998 of the nut 997 can also be used to remove the nut 997 (and, thus, the ferrule 996, the grommet 995, and the ferrule 901) from the cavity of the shell 990. The ferrule 901, the grommet 995, the ferrule 996, and the nut 997 can each have a cavity that traverses therethrough, where each cavity has a shape and size sufficient to allow the cable 1067 to be disposed therein.

Figure 11B:
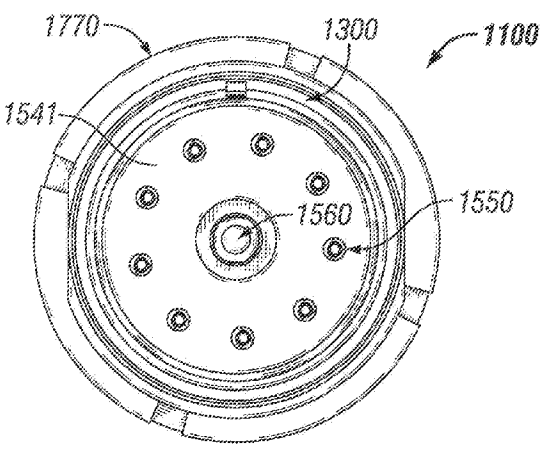
FIGS. 11A-11D show various views of another example electrical connector in accordance with certain example embodiments.
Figure 11A:
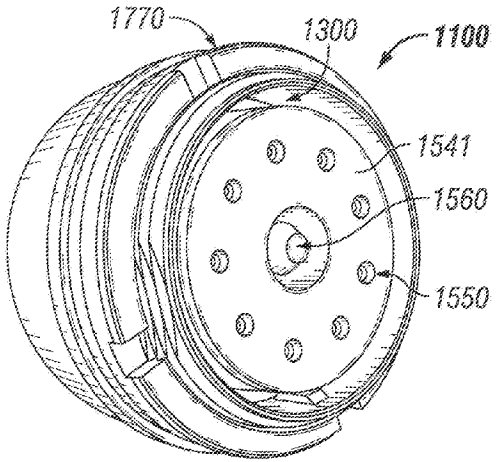
Figure 11D:
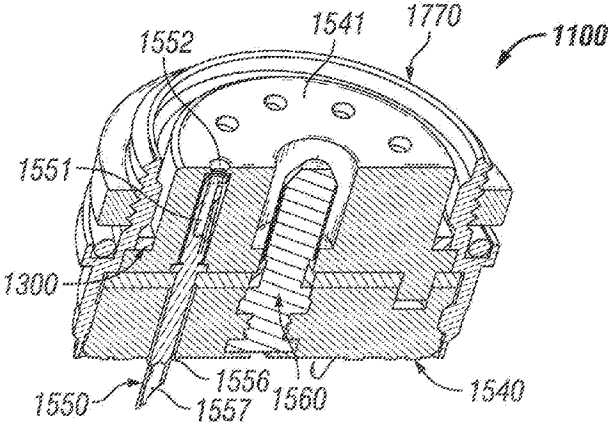
Figure 11C:
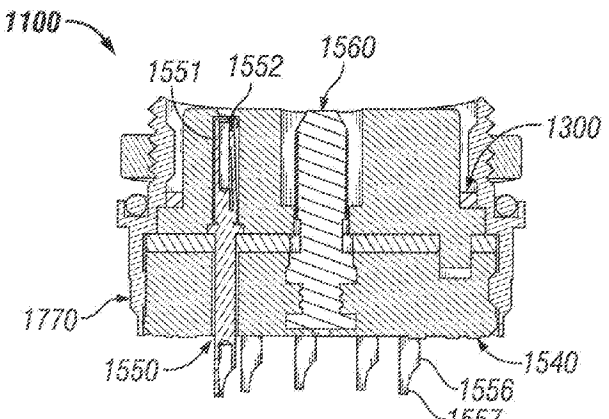

FIGS. 11A-11D show various views of a portion 1100 of an example electrical connector in accordance with certain example embodiments. Specifically, FIG. 11A shows a perspective front view of the portion 1100 of the electrical connector. FIG. 11B shows a top view of the portion 1100 of the electrical connector. FIG. 11C shows a cross-sectional side view of the portion 1100 of the electrical connector. FIG. 11D shows a perspective cross-sectional side view of the portion 1100 of the electrical connector. In one or more embodiments, one or more of the components shown in FIGS. 11A-11D may be omitted, added, repeated, and/or substituted. Accordingly, embodiments of electrical connectors should not be considered limited to the specific arrangements of components shown in FIGS. 11A-11D.

Referring to FIGS. 1A-11D, the portion 1100 of the electrical connector differs from the portion 100 of the electrical connector shown in FIGS. 1A-1C above in a few ways. First, rather than having connector pins 550, the portion 1100 of FIGS. 11A-11D has one or more (in this case, nine) contact receptacles 1550 (also called other names, including but not limited to female receptacles and contact receivers). In other words, the contact receptacles 1550 of the portion 1100 are configured to receive connector pins, such as the connector pins 550 described above. In this case, the contact receptacles 1550 are disposed in a concentric ring, where the contact receptacles 1550 are spaced substantially evenly apart from each other.

Specifically, the distal end of the contact receptacles 1550 can include a wall 1551 that forms a cavity 1552 into which a connector end (e.g., connector end 552) of a connector pin can be inserted. The proximal end of the contact receptacles 1550 can include a stem 1556 capped by an spade 1557. The jack screw 1560 can be substantially the same as the jack screw 560 described above. The jack screw 1560 and the contact receptacles 1550 can be disposed within and traverse the insert 1540. The distal end of the contact receptacles 1550 can be substantially flush with or offset (in this case, slightly recessed) from the distal end 1541 of the insert 1540.

In this case, the insert 1540 is thicker (taller) than the insert 540 described above. In certain example embodiments, there is no bushing or face seal when the insert 1540 has contact receptacles 1550 as opposed to connector pins. Instead, example embodiments of grounding for this portion 1100 shown in FIGS. 11A-11D can involve a sealing member 1300 disposed between the insert 540 and the shell 1770. As with the face seal described above, the sealing member 1300 can be made of one or more materials that are electrically conductive. Such materials can be the same as the materials used for the face seal 300. In such a case, the sealing member 1300 can transfer any stray electrical (e.g., ground) current to the shell 1770, effectively grounding the portion 1100 of the electrical connector.

The sealing member 1300 can have one or more of a number of cross-sectional shapes. For example, in this case, the cross-sectional shape of the sealing member 1300 is rectangular. Other cross-sectional shapes of the sealing member 1300 can include, but are not limited to, circular, square, star-shaped, and irregular. In certain example embodiments, the sealing member 1300 has an inner surface and an outer surface. In such a case, the inner surface can be configured to substantially abut against a portion of the insert 1540, and the outer surface can be configured to substantially abut against a portion of the shell 1770. As a result, substantial contact can be made between the sealing member 1300, the insert 1540, and the shell 1770, allowing for any stray ground current to transfer to the shell 1770.

The sealing member 1300 can be disposed around all or part of an outer surface of the insert 1540. The cross-sectional dimensions (e.g., width, height) of the sealing member 1300 can be substantially the same or different along the length (e.g., circumference) of the sealing member 1300. The sealing member 1300 can also form a liquid-tight seal between the insert 1540 and the shell 1770 in a similar manner in which the sealing member 300 described above could create a liquid-tight seal with the shell 770.

Figure 12A:
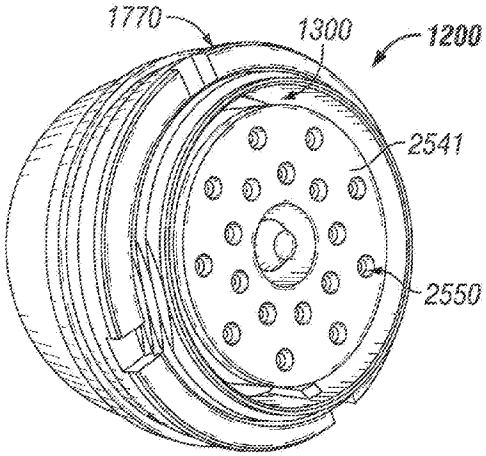
FIGS. 12A-12D show various views of yet another example electrical connector in accordance with certain example embodiments.
Figure 12B:
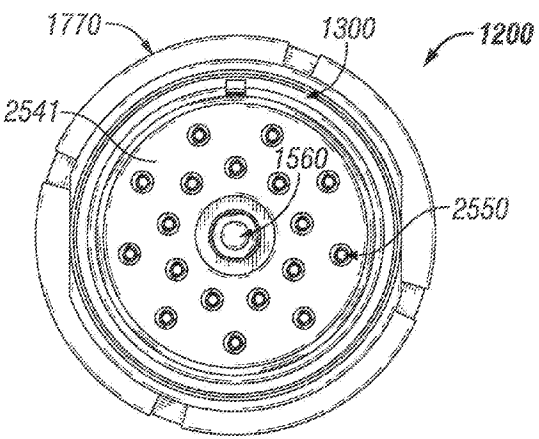
Figure 12C:
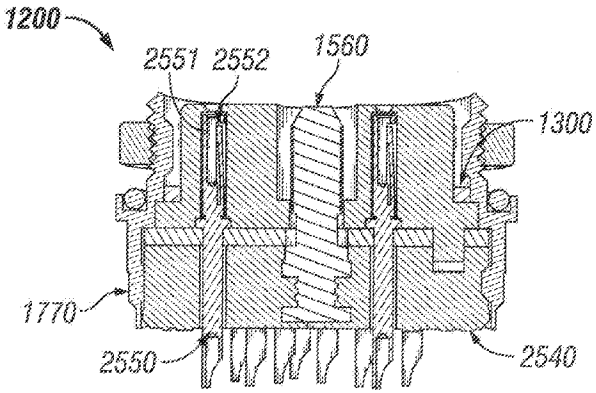
Figure 12D:
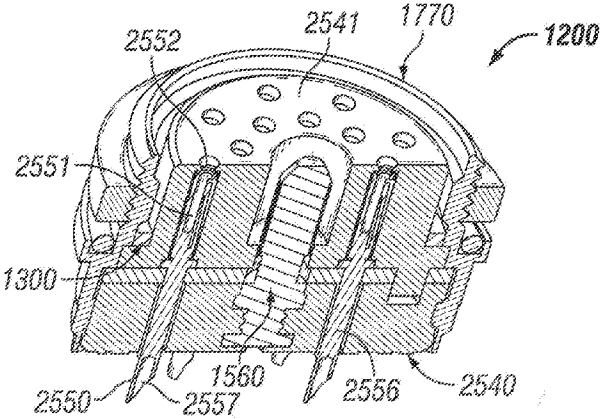

FIGS. 12A-12D show various views of a portion 1200 of yet another example electrical connector in accordance with certain example embodiments. Specifically, FIG. 12A shows a perspective front view of the portion 1200 of the electrical connector. FIG. 12B shows a top view of the portion 1200 of the electrical connector. FIG. 12C shows a cross-sectional side view of the portion 1200 of the electrical connector. FIG. 12D shows a perspective cross-sectional side view of the portion 1200 of the electrical connector. In one or more embodiments, one or more of the components shown in FIGS. 12A-12D may be omitted, added, repeated, and/or substituted. Accordingly, embodiments of electrical connectors should not be considered limited to the specific arrangements of components shown in FIGS. 12A-12D.

Referring to FIGS. 1A-12D, the portion 1200 of the electrical connector of FIGS. 12A-12D differs from the portion 1100 of the electrical connector of FIGS. 11A-11D primarily by the number of contact receptacles 2550 disposed in the insert 1240. In this case, there are 18 contact receptacles 2550 that are disposed in two concentric rings of 9 contact receptacles 2550 apiece, where the contact receptacles 2550 in each of the two concentric rings are spaced substantially evenly apart from each other.

As with the portion 1100 of FIGS. 11A-11D, the contact receptacles 2550 are slightly recessed from the distal end 2541 of the insert 2540. The contact receptacles 2550 can be substantially similar to the contact receptacles 1550 of FIGS. 11A-11D. Specifically, the distal end of the contact receptacles 2550 can include a wall 2551 that forms a cavity 2552 into which a connector end (e.g., connector end 552) of a connector pin can be inserted. The proximal end of the contact receptacles 2550 can include a stem 2556 capped by an spade 2557. Further, the shell 1770, the sealing member 1300, and the other characteristics (e.g., material, overall shape) of the insert 2540 are substantially the same as the corresponding components of the portion 1100 of FIGS. 11A-11D.

Figure 14:
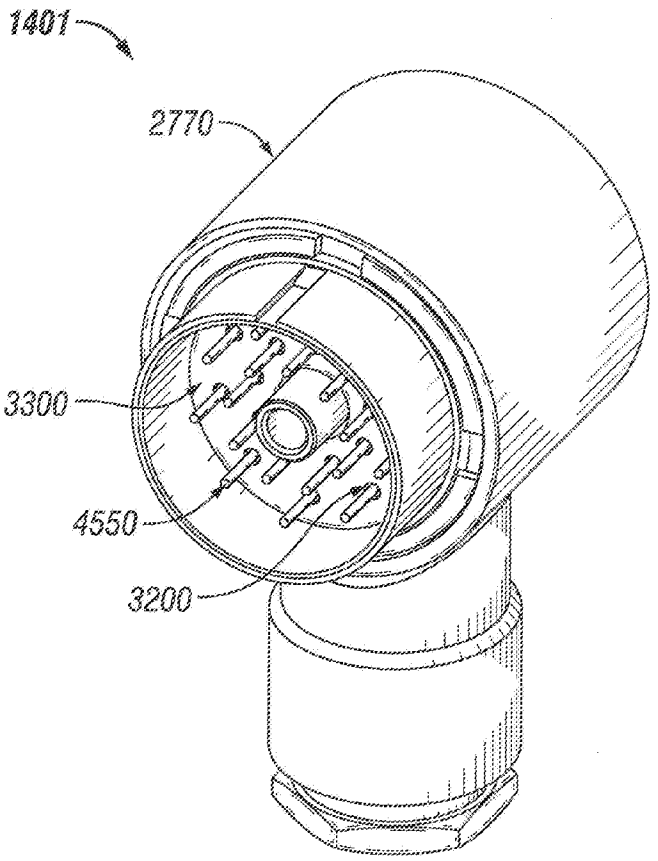
FIG. 14 shows a front perspective view of yet another electrical connector in accordance with certain example embodiments.
Figure 13:
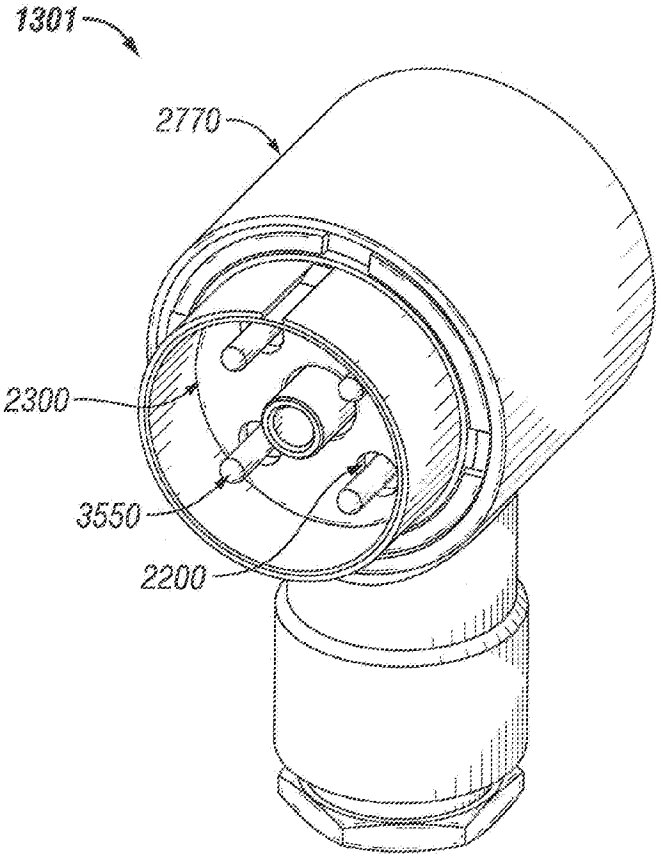
FIG. 13 shows a front perspective view of still another electrical connector in accordance with certain example embodiments.

FIG. 13 shows a front perspective view of a portion 1301 of still another electrical connector in accordance with certain example embodiments, and FIG. 14 shows a front perspective view of a portion 1401 of yet another electrical connector in accordance with certain example embodiments. In one or more embodiments, one or more of the components shown in FIGS. 13 and 14 may be omitted, added, repeated, and/or substituted. Accordingly, embodiments of electrical connectors should not be considered limited to the specific arrangements of components shown in FIGS. 13 and 14.

Referring to FIGS. 1A-14, the shell 2770 of FIG. 13 is substantially the same as the shell 2770 of FIG. 14. The shell 2770 of FIGS. 13 and 14 is configured differently than the other shells (e.g., shell 770, shell 1770) described herein. Specifically, the shell 2770 has a component that is at a substantially right angle to the rest of the shell and can be used to house one or more cables. The shell can have any other shape and/or configuration based on one or more of a number of factors, including but not limited to the physical arrangement of adjacent components and/or devices, the application for which the electrical connector is to be used, and the conditions (e.g., indoor, moisture, cleanliness) to which the electrical connector is exposed. Also, in these cases, the portion 1301 and the portion 1401 include a number of connector pins. Portion 1301 includes four connector pins 3550, and portion 1401 includes 18 connector pins 4550. The connector pins 3550 are larger in size (e.g., wider) than the connector pins 4550.

In addition, the portion 1301 includes a face seal 2300 and a bushing 2200 disposed over each of the connector pins 3550. The bushings 2200 provide physical separation between the connector pins 3550 and the face seal 2300. Further, the face seal 2300 is made of electrically conductive material and provides a path to ground by solidly contacting the electrically conductive shell 2770. Similarly, the portion 1401 includes a face seal 3300 and a bushing 3200 disposed over each of the connector pins 4550. The bushings 3200 provide physical separation between the connector pins 4550 and the face seal 3300. Further, the face seal 3300 is made of electrically conductive material and provides a path to ground by solidly contacting the electrically conductive shell 2770.

Certain example embodiments provide a number of benefits. Examples of such benefits include, but are not limited to, more reliable electrical operation by the reduction or elimination of electromagnetic interference, simplified installation, an ability to retrofit existing electrical connectors without sufficient grounding, simplified inspection, simplified maintenance, and reduced cost.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An electrical connector, comprising:

a first shell having at least one first wall made of an electrically conductive material, wherein the at least one first wall forms a first cavity;

an insert disposed within the first cavity;

at least one connector pin disposed within and traversing the insert;

an electrically conductive face seal that abuts against a distal end of the insert within the first cavity and against an inner surface of the at least one wall of the first shell, wherein the at least one connector pin traverses at least one first aperture in the electrically conductive face seal, wherein the electrically conductive face seal provides a solid ground path with the first shell; and at least one insulating bushing disposed within the at least one first aperture in the electrically conductive face seal, wherein the at least one insulating bushing is further disposed between the electrically conductive face seal and the at least one connector pin, wherein the at least one insulating bushing electrically isolates the at least one connector pin from the electrically conductive face seal;

wherein the at least one first aperture in the electrically conductive face seal comprises a first portion and a second portion, wherein the first portion has a first outer perimeter, and wherein the second portion has a second outer perimeter, wherein the first outer perimeter is greater than the second outer perimeter.

2. The electrical connector of claim 1, wherein the at least one insulating bushing is disposed in the at least one first aperture in the electrically conductive face seal.

3. The electrical connector of claim 1, wherein the electrically conductive face seal further comprises at least one second aperture that traverses therethrough.

4. The electrical connector of claim 1, wherein the electrically insulating bushing comprises a third portion having a third outer perimeter and a fourth portion having a fourth outer perimeter.

5. The electrical connector of claim 1, wherein the electrically conductive face seal further comprises a first coupling feature disposed on a proximal side of the electrically conductive face seal.

6. The electrical connector of claim 5, wherein the distal end of the insert comprises a second coupling feature, wherein the second coupling feature couples to the first coupling feature of the electrically conductive face seal.

7. The electrical connector of claim 1, further comprising:

a sealing member disposed within a channel disposed on an outer surface of the first shell.

8. The electric connector of claim 1, wherein the sealing member abuts against an enclosure to create a liquid-tight seal between the first shell and the enclosure.

9. The electrical connector of claim 8, wherein the at least one connector pin is configured to be electrically coupled to at least one complementary connector pin and to a cable comprising a ground shield, wherein the ground shield is electrically coupled to the electrically conductive face seal via the first shell.

10. The electrical connector of claim 7, wherein the sealing member abuts against a second shell to create a liquid-tight seal between the first shell and the second shell.

* * * * *